US007475870B2

(12) United States Patent
Platt

(10) Patent No.: US 7,475,870 B2
(45) Date of Patent: Jan. 13, 2009

(54) METHOD AND APPARATUS FOR MOUNTING ANGLED FENCE PORTIONS

(76) Inventor: Robert E. Platt, 8701 Highland Ave., Mineral Ridge, OH (US) 44440

( * ) Notice: Subject to any disclaimer, the term of this patent is extended or adjusted under 35 U.S.C. 154(b) by 136 days.

(21) Appl. No.: 11/315,786

(22) Filed: Dec. 22, 2005

(65) Prior Publication Data

US 2007/0145342 A1 Jun. 28, 2007

(51) Int. Cl.
*E04H 17/14* (2006.01)

(52) U.S. Cl. ..... 256/67; 256/59; 256/60; 256/65.11; 256/65.12; 256/66

(58) Field of Classification Search ..... 256/19, 256/22, 59, 60, 65.01, 65.02, 66, 65.11, 67, 256/65.12, 68, 70
See application file for complete search history.

(56) References Cited

U.S. PATENT DOCUMENTS 4,898,365 A * 2/1990 Conner et al. ..... 256/65.12
5,873,564 A * 2/1999 Bisch ..... 256/65.12
6,341,764 B1 * 1/2002 Conner ..... 256/65.12
6,752,385 B2 * 6/2004 Zen et al. ..... 256/65.01
7,025,335 B2 * 4/2006 Zhu ..... 256/22
7,077,386 B1 * 7/2006 Gray et al. ..... 256/67
2006/0076546 A1 * 4/2006 Bertato ..... 256/65.11

* cited by examiner

*Primary Examiner*—Michael P Ferguson
(74) *Attorney, Agent, or Firm*—Sand & Sebolt

(57) ABSTRACT

A mounting attachment for connecting a picket to an angled rail. The mounting attachment comprises a base having an aperture therethrough and into which the picket is inserted. A spring-biased retaining member is provided on the base and is adapted to engage an outer surface of the picket when it is inserted into the aperture. The retaining member urges the picket into contact with the wall of the base which defines the aperture, thus preventing the picket from moving within the aperture and substantially parallel to the longitudinal axis of the rail.

16 Claims, 6 Drawing Sheets

METHOD AND APPARATUS FOR MOUNTING ANGLED FENCE PORTIONS

BACKGROUND OF THE INVENTION

1. Technical Field

This invention generally relates to vinyl fencing systems. More particularly, the invention relates to an apparatus for mounting a picket to a rail. Specifically, the invention relates to a mounting apparatus for securing a picket to an angled rail and which includes a spring-biased retaining member which engages an outer surface of the picket when it is received in an aperture in the mounting apparatus.

2. Background Information

It has become more common in recent years to use vinyl materials for constructing fences and railings because of the material's low maintenance needs and durability. While vinyl fencing is aesthetically pleasing and easy to maintain, the material poses somewhat of a problem for the contractor who must connect the various components together. One of the more problematic areas is the connection of vertical pickets to an angled rail. Railings are typically constructed by installing the bottom rail first, mounting the pickets into the bottom rail, and then connecting the railing together by way of a top handrail or guardrail. The pickets are received into spaced apart apertures which are cut into a side of the bottom rail and a side of the handrail. The installer must estimate the size aperture to be cut into the sides of the rails. If the railing in question is mounted on a deck, this estimation is relatively simply as the aperture can be made to approximately the same dimensions as the picket itself because the picket will be oriented at right angles to the bottom and top rails. However, if the railing is to be mounted at an angle alongside a set of steps, the size of the apertures is more difficult to estimate. This is because the final angle of each picket relative to the rail may not be the angle that the installer used to determine the size of the aperture. Consequently, the installer may overestimate or underestimate the size of the aperture. If the latter occurs, then a larger aperture will have to be cut into the railing, thus adding to the time it takes to install the railing. If the former occurs, then the picket may not be tightly received in the railing and may wobble therein and this tends to give the impression that the railing was poorly constructed. Additionally, it is time consuming to estimate the size aperture for each individual picket, and this increase in installation time adds to the cost of the fencing.

There is therefore a need in the art for an improved method and apparatus for the quick and easy installation of pickets into railings.

SUMMARY OF THE INVENTION

The device of the present invention comprises a mounting attachment for connecting a picket to a rail. The mounting attachment comprises a base having an aperture therethrough and includes a spring-biased retaining member provided on a lower surface of the base. The retaining member has a moveable free end that is adapted to engage an outer surface of the picket when it is inserted into the aperture. The retaining member urges the picket into contact with the circumferential wall that defines the aperture and thereby prevents the picket from moving around within the aperture.

BRIEF DESCRIPTION OF THE DRAWINGS

The preferred embodiment of the invention, illustrative of the best mode in which applicant has contemplated applying the principles, is set forth in the following description and is shown in the drawings and is particularly and distinctly pointed out and set forth in the appended claims.

DETAILED DESCRIPTION OF THE INVENTION

Figure 1:
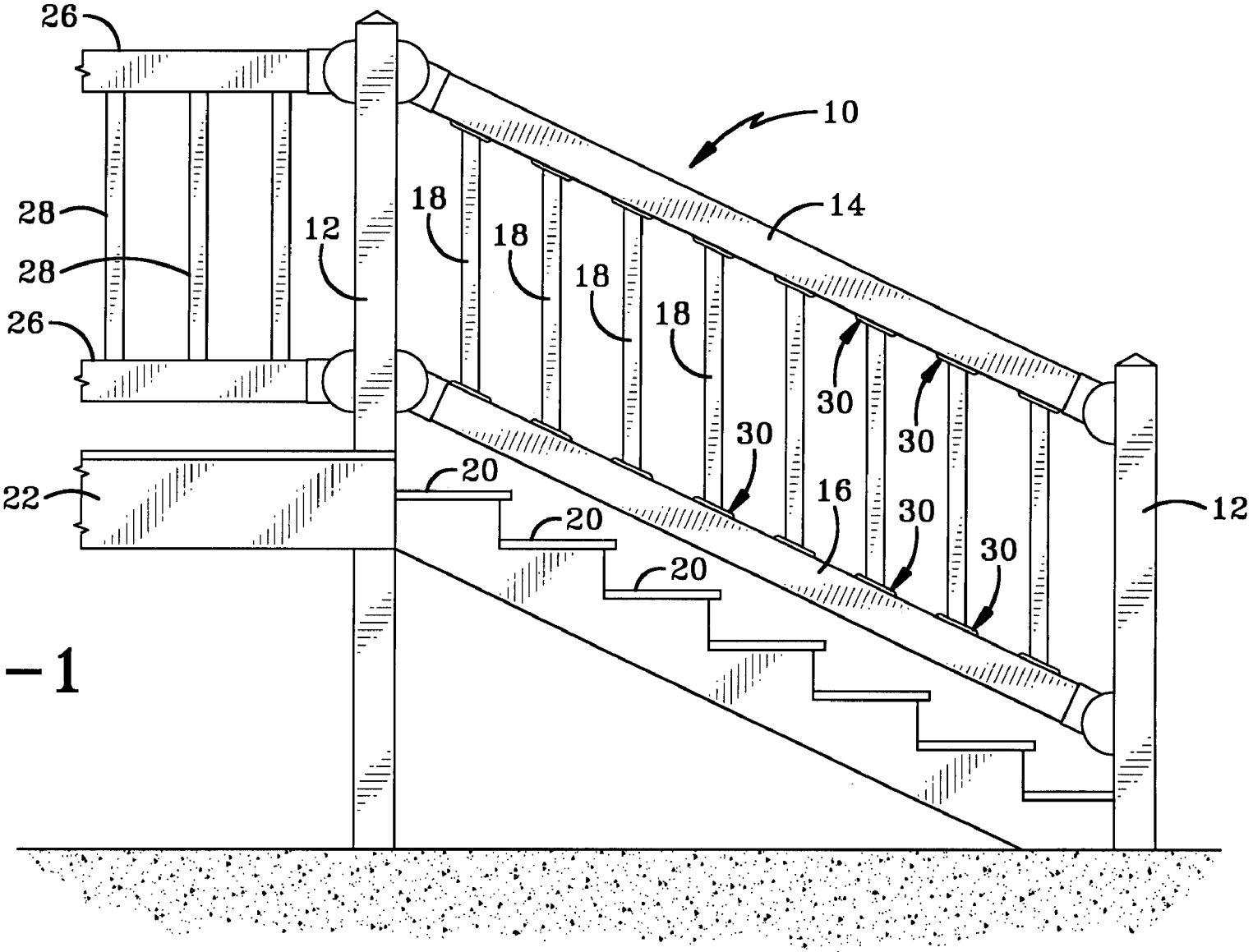
FIG. 1 is a side elevational view of a stair railing including the mounting attachment of the present invention.
Figure 2:
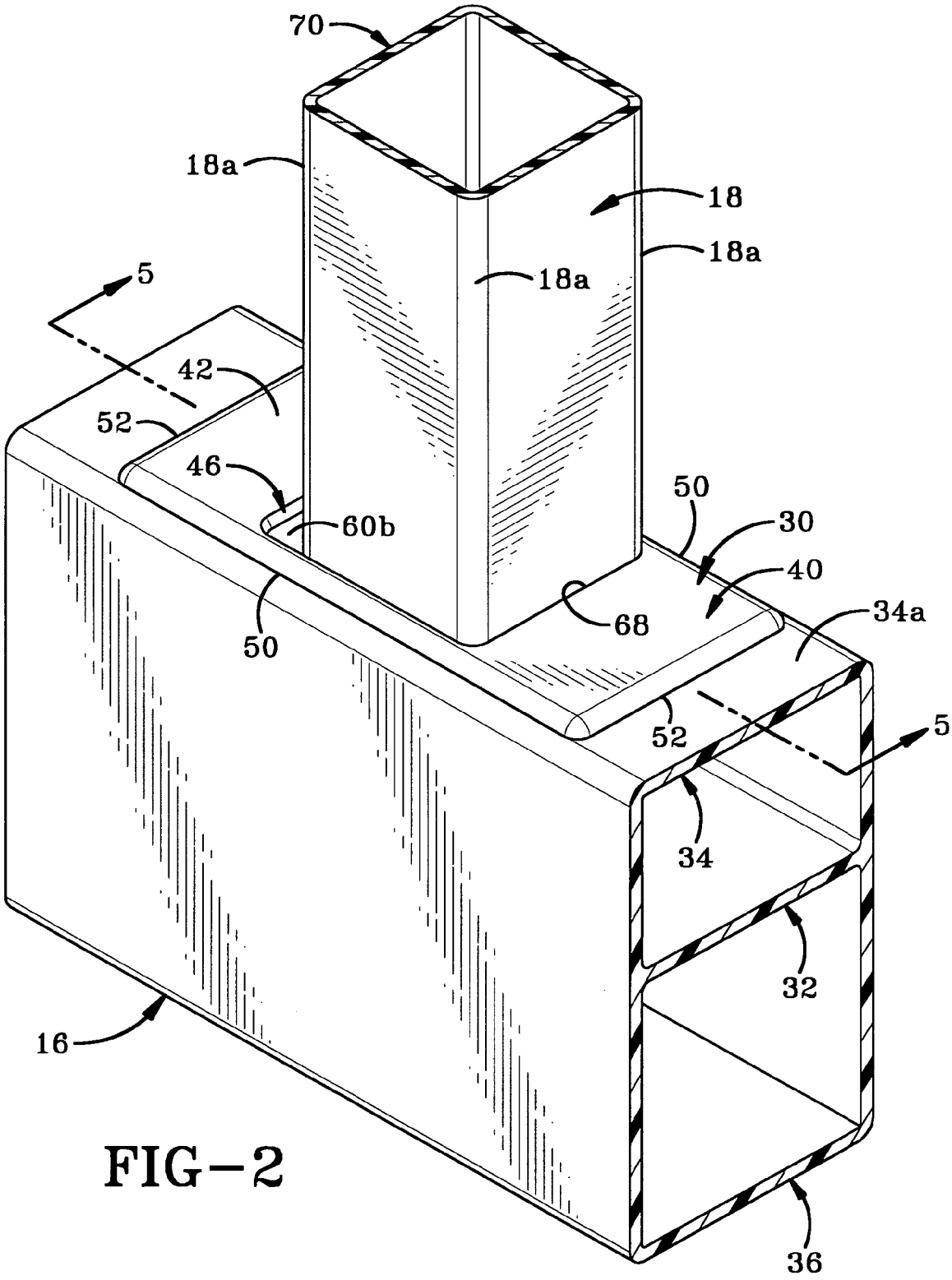
FIG. 2 is a partial perspective view of a rail and picket connected together with the mounting attachment of the present invention.
Figure 3:
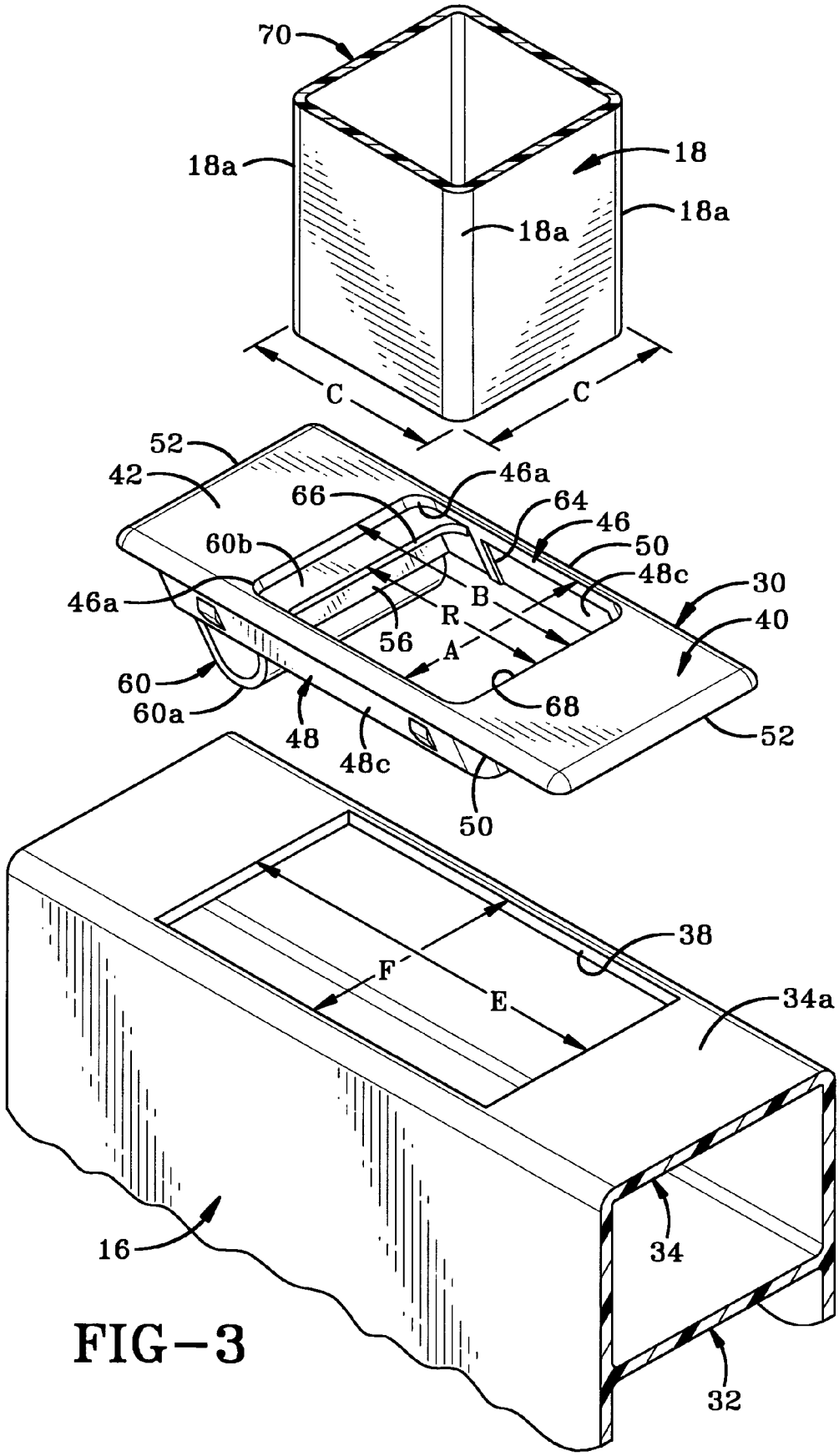
FIG. 3 is an exploded perspective view of the rail, picket and mounting attachment.
Figure 4:
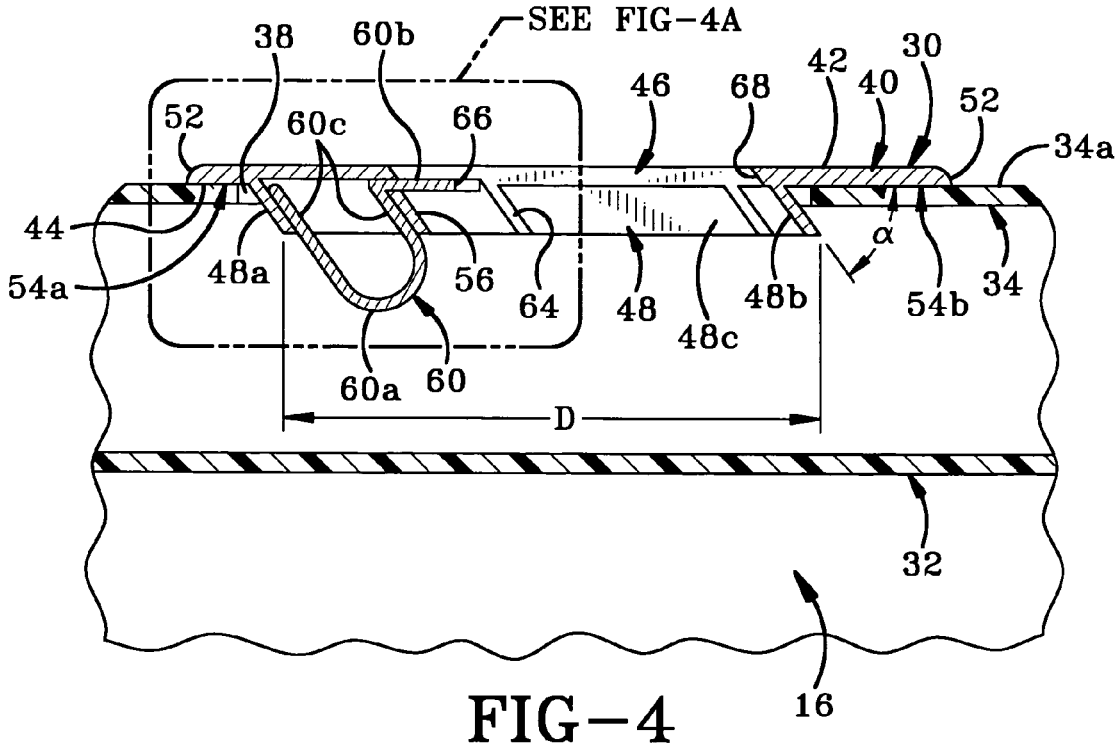
FIG. 4 is a cross-sectional side view through the rail and mounting attachment prior to the insertion of a picket.

Referring to FIG. 1 there is shown a stair railing 10 including vertically oriented posts 12, upper and lower rails 14, 16, and a plurality of pickets 18 connected therebetween. Railing 10 is disposed alongside a flight of stairs 20 which extend downwardly from a deck 22. A deck railing 24 is connected to one of posts 12 and includes a plurality of deck rails 26 with a plurality of deck pickets 28 connected therebetween.

Referring to FIGS. 2-4A, there is shown a mounting attachment in accordance with the present invention and generally indicated at 30. Mounting attachment 30 is adapted to connect one of the pickets 18 to a fence rail 16. Fence rail 16 preferably includes an interior septum 32 disposed between opposing upper and lower side walls 34, 36. One of side walls 34 has a generally rectangular hole 38 (FIG. 3) cut therein. Mounting attachment 30 comprises a base 40 having an upper surface 42 and a lower surface 44. As may be seen from FIG. 3, an aperture 46 is formed through base 40 and is generally rectangular in shape, having a width "A" (FIG. 3) and a length "B", with the length "B" being greater than the width "A". The width "A" of aperture 46 is substantially equal to the width "C" of the picket 18 that base 40 is designed to connect to rail 16. The length "B" of aperture 46 is greater than the length "C" of picket 18. Picket 18 has rounded outer corners 18*a* and aperture 46 is similarly shaped with rounded inner corners 46*a*.

A circumferential wall 48 (FIGS. 3&4) extends outwardly away from lower surface 44 of base 40. The length "D" (FIG. 4) of circumferential wall 48 is substantially equal to the length "E" (FIG. 3) of hole 38 in rail 16. The width (not shown) of circumferential wall 48 is substantially equal to the width "F" of hole 38. Wall 48 preferably includes ends 48*a*, 48*b* that are disposed at an angle $\alpha$ (FIG. 4) relative to lower surface 44 of base 40. Angle $\alpha$ is between 40° and 50° and preferably is 45°. Wall 48 further includes opposing sides 48*c*, 48*c* which connect ends 48*a* and 48*b* together. Sides 48*c*, 48*c* extend outwardly away from lower surface 44 of base 40 and substantially at ninety degrees thereto. Although not shown in the drawings, sides 48*c* are spaced a small distance inwardly from the outer edges 50 (FIG. 3) of base 40, thus creating a lip area (not shown) that is adapted to abut the outer surface 34*a* of side wall 34 when mounting attachment 30 engages rail 16. Furthermore, ends 48*a* and 48*b* are spaced inwardly from edges 52, thus forming lip areas 54*a*, 54*b*, respectively. Lip areas 54*a*, 54*b* are adapted to abut the outer surface 34*a* of side wall 34 when mounting attachment 30 engages rail 16. An angled divider 56 extends between sides 48*c*, 48*c* and is disposed a spaced distance inwardly from end 48*a* and is substantially parallel thereto. Divider 56 is also disposed at substantially the same angle α to the lower surface 44 of base as are ends 48*a* and 48*b*. A slot 58 (FIG. 4A) is formed along substantially the entire length of divider 56 and adjacent lower surface 44 of base 40. The perimeter of base, being edges 50 and 52, is beveled to remove sharp edges and to give mounting attachment 30 a more aesthetically pleasing and finished appearance.

In accordance with another specific feature of the present invention, mounting attachment 30 is provided with a spring-biased retaining member 60. Retaining member 60 may be manufactured from any suitable material which will allow member 60 to be partially compressed and then return to its original shape. A suitable material for member 60 may be the same vinyl from which base 40 is molded or, alternatively, can be any suitable metal. Retaining member 60 includes a first portion 60*a* that is substantially U-shaped having a pair of legs 60*c*. Retaining member 60 is received between end 48*a* and divider 56. First portion 60*a* extends substantially between the sides 48*c*, 48*c* of circumferential wall 48. A second portion 60*b* of retaining member 60 extends outwardly at an angle from a top end of one of the legs 60*c* of first portion 60*a* and through the slot 58. Upper surface 42 of base 42 extends partially into aperture 46 proximate the sides 50 of base. This forms a narrow ledge 62 that extends into aperture and ledge 62 acts as a guide for the outermost side edges (not numbered) of the substantially planar second portion 60*b* of retaining member 60. A ridged stop 64 is provided on the interior surfaces of each of said sides 48*c*, 48*c*. Second portion 60*b* can slide reciprocally along ledges 62. Second portion 60*b* also includes free end 66 which is adapted to engage picket 18. When free end 66 engages picket 18, second portion 60*b* is forced to slide in the direction of arrow "X" (FIG. 4A), thereby placing first portion 60*a* under compression with the upper ends of legs 60*c* being forced closer together. When free end 66 is no longer engaged by picket 18, the first portion 60*a* reverts back to its original shape, causing the second portion 60*b* to slide along ledges 62 toward stops 64. When retaining member 60 is in its rest position, the free end 66 of second portion 60*b* is urged toward stop 64. As may be most easily seen in FIG. 3, second portion 60*b* extends partially into the aperture 46 in base 40. The length "B" of aperture 46 can therefore be effectively reduced by second portion 60*b* to a variable length "R". Length "R" is that distance between a segment 68 of the base 40 that defines aperture 46, and free end 66 of second portion 60*b*. Length "R" is variable because the free end 66 can be forced to slide backwardly away from segment 68 and along ledge 62 to varying degrees and can be urged forwardly toward segment 68 by the spring-biased retaining member 60 to varying degrees.

Figure 5:
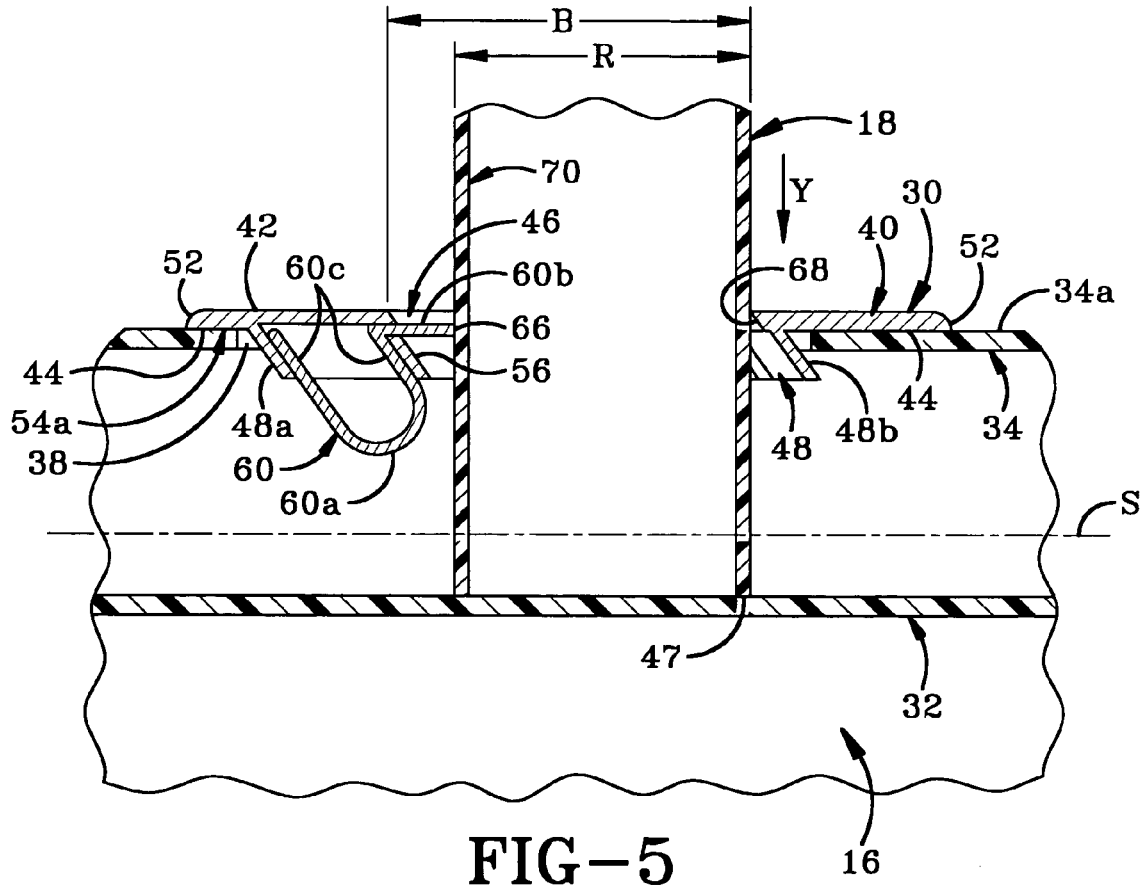
FIG. 5 is a cross-sectional side view through the rail and mounting attachment and showing the picket inserted into the mounting attachment and being disposed at right angles to the rail.
Figure 4A:
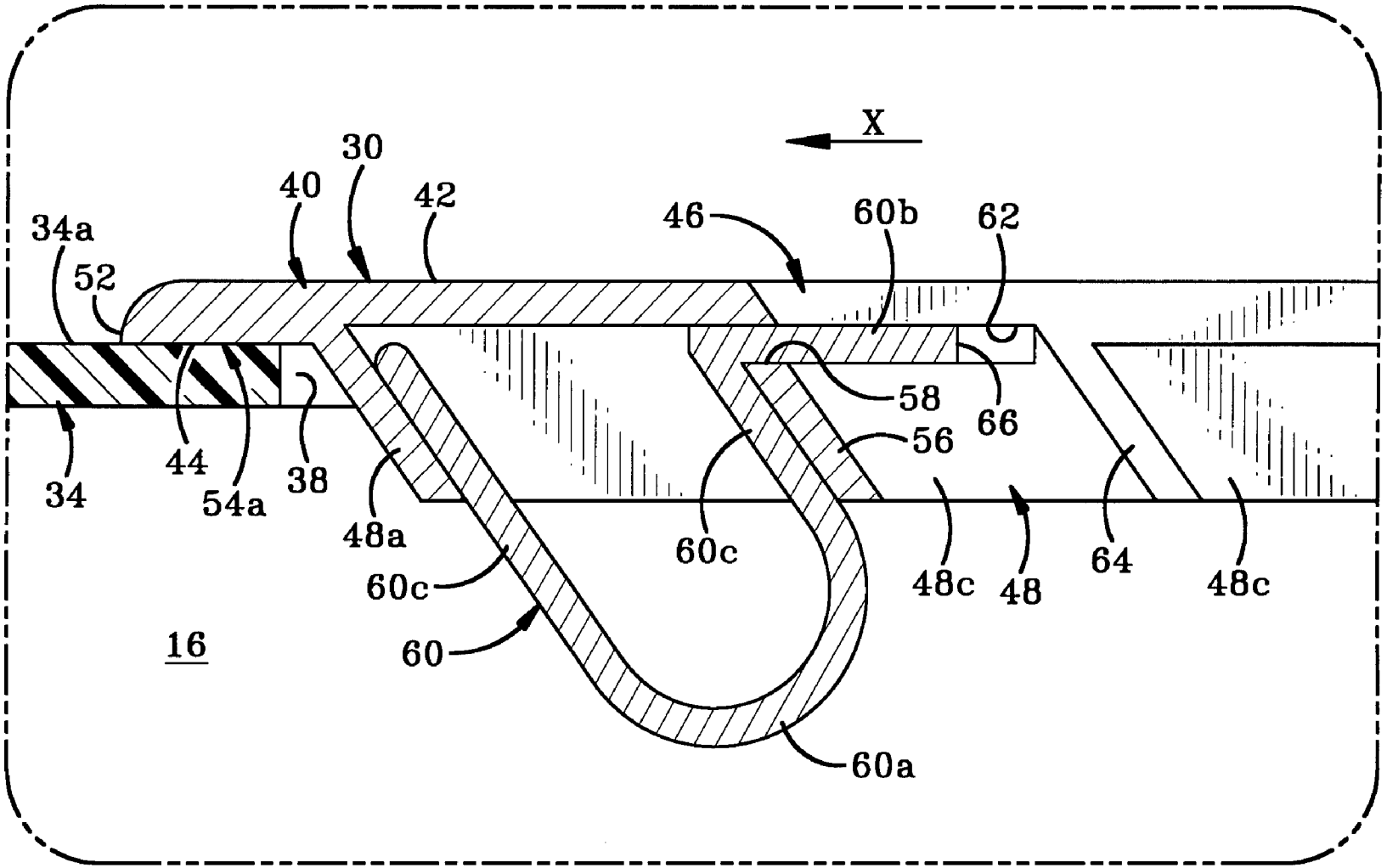
FIG. 4A is an enlargement of the highlighted area of FIG. 4.
Figure 6:
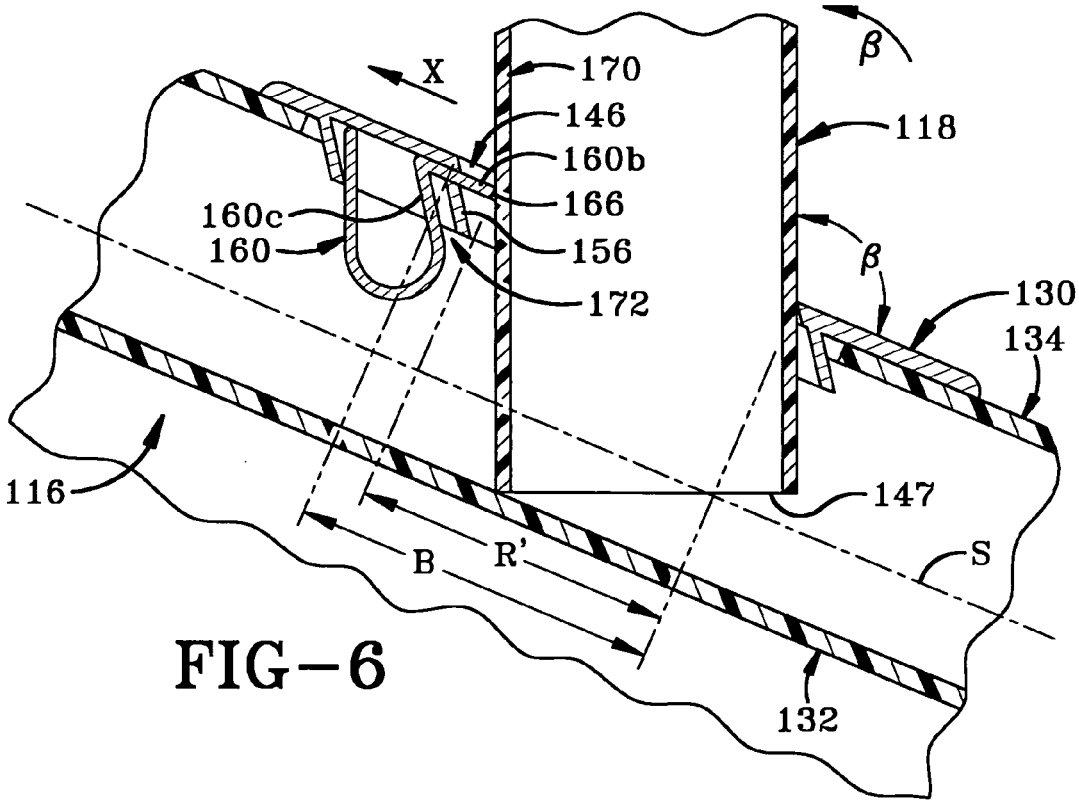
FIG. 6 is a cross-sectional side view through the rail and mounting attachment and showing the picket initially inserted into the mounting attachment and being disposed at an angle other than ninety degrees to the rail.
Figure 7:
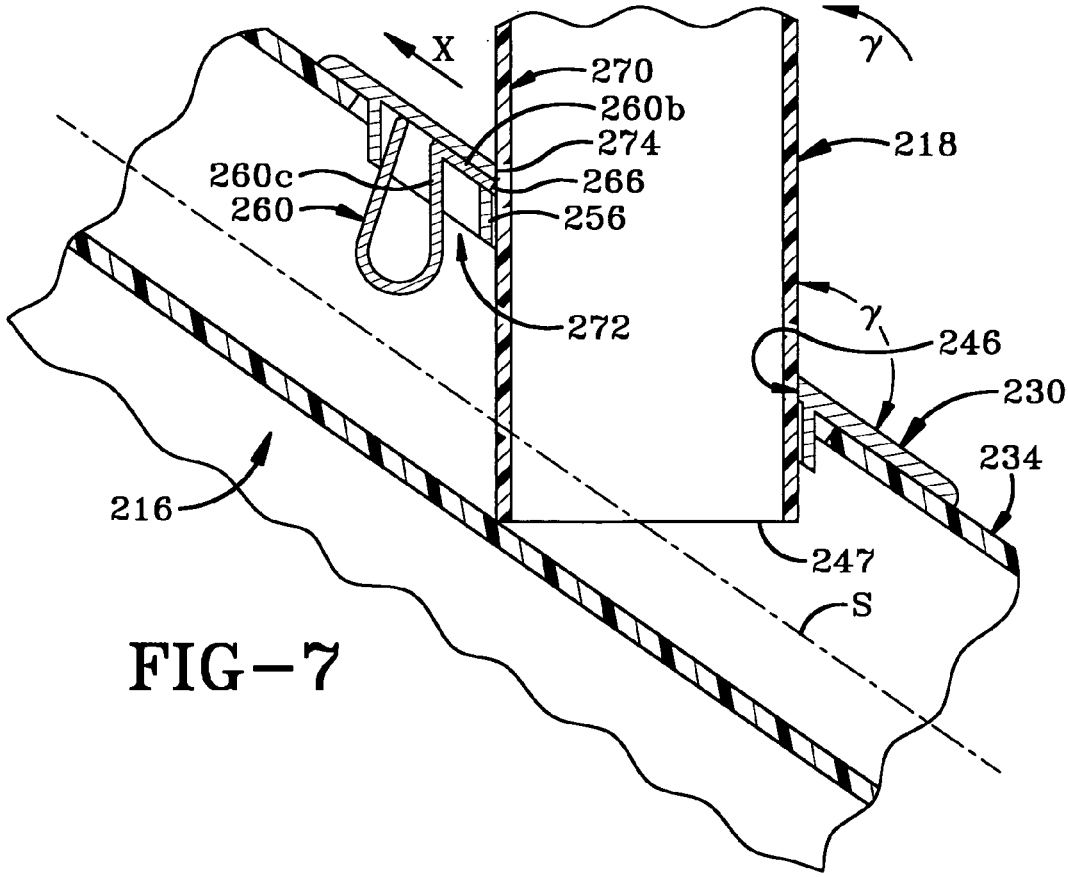
FIG. 7 is a cross-sectional side view through the rail, mounting attachment and picket where the spring-biased clip is locking the picket into the mounting attachment.

Referring to FIGS. 5-7, mounting attachment 30 is used in the following manner. Mounting attachment 30 is snap-fitted into hole 38 in upper side wall 34 of rail 16 by inserting circumferential wall 48 through hole 38. Because of the tight fit between circumferential wall 48 and upper side wall 34, and because of the angle of ends 48*a*, 48*b*, mounting attachment 30 is effectively secured to rail 16 and cannot accidentally be removed therefrom. It will be understood however, that if the installer chooses to do so, fasteners may be inserted through base 40 and into upper side wall 34. When mounting attachment 30 is secured to rail 16 in this manner, the lower surface 44 of base 40 lies in abutting contact with the outer surface 34*a* of rail 16 and the aperture 46 in base 40 is aligned with hole 38 in rail 16. The installer then inserts picket 18 through aligned aperture 46 and hole 38 and pushes picket 18 inwardly in the direction of arrow "Y" (FIG. 5) until an end 47 thereof abuts septum 32. As picket 18 is inserted through aperture 46, the outer surface of wall 70 thereof engages free end 66 of retaining member 60, and forces free end 66 in the direction of arrow "X". This movement of second portion 60*b* places first portion 60*a* of retaining member 60 under compression by causing legs 60*c*, 60*c* to move toward each other. The compressed first section 60*a* consequently exerts an equal and opposite force on second portion 60*b* thereby urging free end 66 into abutting contact with wall 70 of picket 18. Picket 18 is therefore retained within the mounting attachment 30 between free end 66 of retaining member 60 and segment 68 of base 40. There is also no gap created between free end 66 and wall 70 and consequently picket 18 cannot move around within aperture 46. The distance between segment 68 and free end 66 is the length "R", which length is less than the length "B" of aperture 46. The second rail 14 is then secured to the opposite end (not shown) of picket 18. Because the free end 66 of retaining member 60 is urged into engagement with the outer surface of wall 70, the picket 18 is substantially retained in position and is less able to slide within aperture 46 and substantially parallel to the longitudinal axis "S" of the rail 16. Picket 18 is substantially prevented from moving in a widthwise direction, i.e., at right angles to the longitudinal axis "S" of rail 16 because the picket 18 and aperture 46 are substantially equal in width.

FIG. 6 illustrates the orientation of the various components when picket 118 is engaged by mounting attachment 130 at an angle β relative to upper side wall 134 of rail 116. In this instance, picket 118 is inserted through aperture 146 until end 147 of picket 118 engages septum 132. Picket 118 is then rotated through angle β, lifting all but a small part of end 147 out of engagement with septum 132 and simultaneously forcing free end 166 of second portion 160*b* in the direction of arrow X. As picket 118 is rotated and retaining member 160 is compressed, a small gap 172 opens up between divider 156 and the adjacent leg 160*c* of retaining member 160. The compression of retaining member 160 effectively urges free end 166 into abutting contact with the outer surface of wall 170 of picket 118. This secures picket 118 within the reduced length "R'" of aperture 146. Because second portion 160*b* of retaining member 160 is forced further away from segment 168 of mounting attachment 130 than is the case when picket 118 is disposed substantially at right angles to side wall 134, length "R'" is greater than length "R", but is still less than "B". A second rail (not shown) is then secured to the opposite end of picket 118 in a similar manner. Because the free end 166 of retaining member 160 is urged into engagement with the outer surface of wall 170, the picket 118 is substantially retained in position and is less able to slide within aperture 146 relative to the longitudinal axis "S" of the rail 116.

FIG. 7 illustrates that mounting attachment 230 may be used to engage a picket 218 at an even greater angle γ relative to upper side wall 234 of rail 216. In this instance, picket 218 is rotated by an angle γ and outer surface of wall 270 forces free end 266 of retaining member 260 in the direction of arrow X until free end 266 is substantially aligned with segment 274 of mounting attachment 230 which defines aperture 246. This opens up an even larger gap 272 between leg 260*c* and divider 256 and places retaining member 260 under even greater compression. As before, the compressed second portion 260*b* is urged against wall 270 of picket 218. A second rail (not shown) is then connected to the opposite end of picket 218 in a similar fashion. The compression of retaining member 260 keeps free end 266 urged into abutting contact with the outer surface of wall 270 of picket 218 and thereby substantially prevents picket 218 from sliding within aperture 246 and substantially parallel to the longitudinal axis "S" of rail 216.

It will be understood that while the preferred embodiment of mounting attachment has been disclosed as including a spring-biased retaining member therein, a non-spring biased retaining member (not shown) could be provided. The free end of this latter retaining member could be locked against the outer surface of wall 70 of picket 18 by a fastener (not shown) for example. Any other suitable means of reducing the effective length of the aperture 46 may be provided on base 40.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A mounting attachment for connecting a picket to a fence rail, wherein the fence rail includes a picket-receiving hole defined in a side wall thereof; and wherein said mounting attachment comprises:

a base adapted to be mounted on the side wall of the rail proximate the hole; said base having an upper surface, a lower surface and an inner circumferential wall that is complementary sized and shaped to be tightly received within the hole when the base is mounted on the rail; and wherein said circumferential wall has an interior surface and opposing sides;

an aperture defined in the inner circumferential wall, and when the base is mounted on the rail the lower surface thereof abuts an exterior surface of the side wall and the aperture is aligned with the hole;

a retaining member mounted on the lower surface of the base; said retaining member comprising a spring adapted to engage an outer surface of the picket received through the aligned aperture and hole and to bias the picket into engagement with the inner circumferential wall; said retaining member having a free end that is movable at least partially across the aperture between a first position where the free end extends a first distance into the aperture and a second position where the free end extends a second distance into the aperture; and wherein the first distance is greater than the second distance; and wherein adjustment of the angle of the outer surface of the picket relative to the side wall of the rail moves the free end of the retaining member one of toward and away from a portion of the interior surface of the circumferential wall; and wherein the interior surface of the circumferential wall includes a ridge on each of the opposing sides; said ridges being aligned with each other and being disposed a spaced distance inwardly from one of the ends.

2. The mounting attachment as defined in claim 1, wherein the free end of the retaining member is adapted to engage the outer surface of the picket; and the insertion of the picket through the aligned aperture and hole moves the retaining member from the first position to the second position.

3. The mounting attachment as defined in claim 1, wherein the free end of the retaining member is adapted to engage the outer surface of the picket; and wherein the removal of the picket from within the aligned aperture and hole moves the retaining member from the second position to the first position.

4. The mounting attachment as defined in claim 1, wherein the circumferential wall extends outwardly and away from the lower surface of the base.

5. The mounting attachment as defined in claim 1, wherein the circumferential wall includes a pair of opposing ends and a pair of opposing sides; and wherein the opposing sides extend outwardly from the lower surface at an angle of substantially ninety degrees thereto.

6. The mounting attachment as defined in claim 5, wherein the opposing ends extend outwardly from the lower surface and at an acute angle thereto.

7. The mounting attachment as defined in claim 1, wherein the ridges are angled relative to the lower surface of the base and at substantially the same angle as the ends.

8. The mounting attachment as defined in claim 1, wherein the interior surface further includes a ledge formed on each of the opposing sides; each of said ledges extending from proximate the one of the ends to proximate the respective ridge.

9. The mounting attachment as defined in claim 1, wherein the base has a beveled outer perimeter.

10. A mounting attachment, for connecting a picket to a fence rail, wherein the fence rail includes a picket-receiving hole defined in a side wall thereof; and wherein said mounting attachment comprises:

a base adapted to be mounted on the side wall of the rail proximate the hole, the base having an upper surface, a lower surface and an inner circumferential wall; and wherein the circumferential wall has an interior surface, opposing ends and opposing sides and the interior surface includes a ridge on each of the opposing sides; said ridges being aligned with each other and being disposed a spaced distance inwardly from one of the ends; and wherein the interior surface further includes a ledge formed on each of the opposing sides; each ledge extending from proximate the one of the ends to proximate the respective ridge;

an aperture defined in the inner circumferential wall; and when said base is mounted on the rail the lower surface thereof abuts an exterior surface of the side wall of the rail and the aperture is aligned with the hole therein; and a retaining member mounted on the base; said retaining member comprising a spring adapted to engage an outer surface of a picket received through the aligned aperture and hole and to bias the picket into engagement with the inner circumferential wall; said retaining member having a first portion that is substantially U-shaped in cross section and a second portion that is substantially planar in cross section; and wherein the second portion of the retaining clip member has edges that are disposed proximate the ledges on the opposing sides and are guided there along as retaining member moves.

11. The mounting attachment as defined in claim 10, wherein the U-shaped first portion includes two legs and wherein the second portion extends outwardly from one of the legs and at an angle thereto.

12. The mounting attachment as defined in claim 11, wherein the second portion of the retaining clip member has a free end that is disposed remote from the legs of the first portion and wherein the free end is adapted to engage an outer wall of the picket when the picket is inserted into the aperture in the base.

13. A mounting attachment for securing a picket in a hole in a fence rail; said mounting attachment comprising:

a base having:

a lower surface adapted to abut an outer surface of the fence rail;

a first wall extending outwardly away from the tower surface of the base and adapted to be received through the hole in the fence rail;

a second wall spaced a distance from the first wall, wherein the second wall has an inner edge spaced a distance away from the lower surface of the base; whereby a gap is defined between the inner edge and the lower surface;

an aperture defined in the base; whereby the aperture is alignable with the hole in the fence rail; and a spring member adapted to bias a picket into engagement with a portion of the base; said spring member being fixedly secured at a first end to the first wall and having a free second end that is movable toward and away from the first end; whereby the free second end is adapted to move toward the first end when a picket is inserted through the aperture and to move away from the first end when the picket is removed from the aperture; and wherein the spring member comprises a U-shaped portion that is disposed between the first and second walls and a planar portion that is received in the gap and is disposed substantially parallel to the lower surface of the base.

14. The mounting attachment as defined in claim 13, wherein the first end of the spring member comprises a leg of the U-shaped portion, and the free end of the spring member comprises an outermost end of the planar portion of the spring member.

15. The mounting attachment as defined in claim 14, wherein the planar portion of the spring member is slidable across at least a portion of the aperture and is adapted to engage an outer surface of the picket.

16. The mounting attachment as defined in claim 15, wherein the first wall circumscribes the aperture; and the first wall further includes a stop that limits the sliding motion of the planar portion of the spring member.

* * * * *

UNITED STATES PATENT AND TRADEMARK OFFICE

CERTIFICATE OF CORRECTION

PATENT NO. : 7,475,870 B2
APPLICATION NO. : 11/315786
DATED : January 13, 2009
INVENTOR(S) : Robert E. Platt It is certified that error appears in the above-identified patent and that said Letters Patent is hereby corrected as shown below:

Column 6, line 53 delete “clip” should read -- retaining member has edges that are disposed --

Column 6, line 61 delete “clip” should read -- the second portion of the retaining member has --

Column 7, line 7 change “tower” to “lower” -- extending outwardly away from the lower surface of the --

Signed and Sealed this

Fourteenth Day of April, 2009

John Doll

JOHN DOLL
*Acting Director of the United States Patent and Trademark Office*